US009775378B2

(12) United States Patent
Möhring et al.

(10) Patent No.: US 9,775,378 B2
(45) Date of Patent: Oct. 3, 2017

(54) CIGARETTE PAPER COMPRISING FLAKY FILLER

(71) Applicant: DELFORTGROUP AG, Traun (AT)

(72) Inventors: Dieter Möhring, Wattens (AT); Roland Zitturi, Innsbruck (AT); Dietmar Volgger, Schwaz (AT)

(73) Assignee: delfortgroup AG, Traun (AT)

( * ) Notice: Subject to any disclaimer, the term of this patent is extended or adjusted under 35 U.S.C. 154(b) by 178 days.

(21) Appl. No.: 14/552,714

(22) Filed: Nov. 25, 2014

(65) Prior Publication Data

US 2015/0090284 A1 Apr. 2, 2015

Related U.S. Application Data

(63) Continuation of application No. PCT/EP2013/060295, filed on May 17, 2013.

(30) Foreign Application Priority Data

Jun. 1, 2012 (DE) ..... 10 2012 104 773

(51) Int. Cl.
*A24D 1/02* (2006.01)
*D21H 27/00* (2006.01)
(Continued)

(52) U.S. Cl.
CPC ..... *A24D 1/02* (2013.01); *A24D 1/025* (2013.01); *A24D 1/027* (2013.01); *D21H 15/02* (2013.01);
(Continued)

(58) Field of Classification Search
USPC ..... 162/139, 181.1, 181.2, 181.5; 131/349, 131/365
See application file for complete search history.

(56) References Cited

U.S. PATENT DOCUMENTS 3,830,126 A * 8/1974 Ringe ..... A24C 5/28 83/310
5,075,093 A * 12/1991 Tanaka ..... C01F 11/181 106/464
(Continued)

FOREIGN PATENT DOCUMENTS

CN 101508454 A 8/2009
RU 2 246 445 C2 2/2005

OTHER PUBLICATIONS

Product sheet, Sodium polyacrylate agriculture grade, Alibaba, 1999, pp. 1-3 and 7, [online], Retrieved from the Internet, [retrieved Feb. 16, 2017, <URL: https://www.alibaba.com/product-detail/sodium-polyacrylate-agriculture-grade_1892821785.html>.*
(Continued)

*Primary Examiner* — Dennis Cordray
(74) *Attorney, Agent, or Firm* — Sunstein Kann Murphy & Timbers LLP

(57) ABSTRACT

A cigarette paper contains pulp fibers and filler particles, whereby at least 20% of the filler particles, by mass or by particle number, have a flaked shape. The flaked filler particles have a length l, a width b and a thickness d, which correspond to the respective maximum extension in three mutually orthogonal spatial directions, whereby the length l as well as the width b are at least twice as large as the thickness d. The mass-specific median value $d_{50}$ of the particle size distribution measured according to ISO 13317-3 is between 0.2 μm and 4.0 μm, and the flaked particles are formed by calcium carbonate.

17 Claims, 1 Drawing Sheet

(51) Int. Cl.
*D21H 15/02* (2006.01)
*D21H 17/67* (2006.01)
*D21H 21/52* (2006.01)

(52) U.S. Cl.
CPC ..... *D21H 17/675* (2013.01); *D21H 21/52* (2013.01); *D21H 27/00* (2013.01)

(56) References Cited

U.S. PATENT DOCUMENTS 5,253,660 A 10/1993 Dixit ..... 131/365
5,888,348 A * 3/1999 Hampl, Jr. ..... A24D 1/02 131/365
6,830,053 B2 * 12/2004 Tanaka ..... A24D 1/02 131/365
7,077,145 B2 * 7/2006 Seymour ..... A24C 5/00 131/35
7,128,887 B2 * 10/2006 Huhn, III ..... C01F 11/181 106/464
8,551,428 B2 * 10/2013 Pohl ..... C01F 5/24 423/165
2003/0131860 A1 * 7/2003 Ashcraft ..... A24D 1/025 131/365
2004/0247513 A1 * 12/2004 Huhn, III ..... C01F 11/181 423/432
2007/0068640 A1 * 3/2007 Pfalzer ..... D21H 17/70 162/9
2009/0044819 A1 2/2009 Fritzsching ..... 131/365

OTHER PUBLICATIONS

"A User Guide for the Determination of the Diffusion Capacity (D*) of Cigarette Papers", Coresta Guide N°14, 2013, pp. 1-15.*
Norman et al, "Measurement of Gas Diffusion Capacity of Cigarette Papers", Beiträge zur Tabakforschung International/Contributions to Tobacco Research, v. 21, No. 8 (2005, pp. 425-434.*
Eitzinger, *The Influence of the Pore Size Distribution of Cigarette Paper on its Diffusion Constant and Air Permeability*, 2005 Joint Meeting of the Coresta Product Technology and Smoke Science Study Groups, Stratford upon Avon, UK, Sep. 4-8, 2005. 8 pages.

* cited by examiner

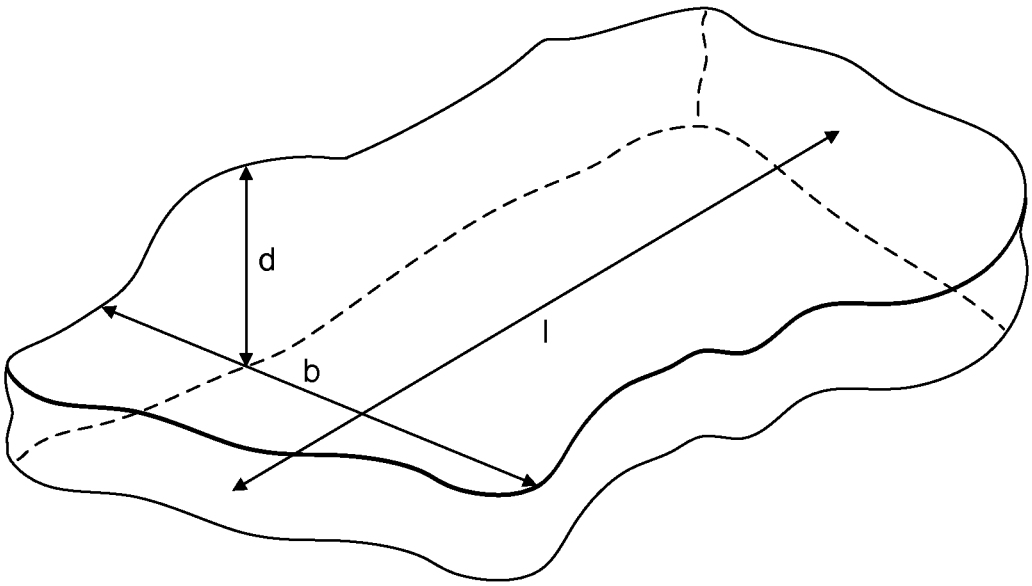
d
l
b

CIGARETTE PAPER COMPRISING FLAKY FILLER

This application is a continuation of Patent Cooperation Treaty Application PCT/EP2013/060295, filed May 17, 2013, which claims priority from German Patent Application 10 2012 104 773.1, filed Jun. 1, 2012, which are incorporated herein by reference in their entireties.

TECHNICAL FIELD

The present invention relates to a cigarette paper, containing pulp fibers and filler particles. The term "containing" does not exclude that the cigarette paper contains further components. Particularly it is related to a cigarette paper, which allows the amount of carbon monoxide in the cigarette smoke to be reduced, and also to an associated corresponding cigarette.

BACKGROUND ART

Cigarette smoke is known to contain a lot of harmful substances, among them carbon monoxide. Hence, there is a great interest in the industry to produce cigarettes, the smoke from which contains considerably fewer harmful substances. To reduce the amount of such substances, cigarettes are often provided with filters, typically made out of cellulose acetate. However, these filters are not able to reduce the amount of carbon monoxide in the cigarette smoke, since cellulose acetate cannot absorb carbon monoxide. Various suggestions for incorporating catalysts into the filter, to convert carbon monoxide into less harmful carbon dioxide, were not successful, partly for functional, partly for economic reasons.

Diluting the smoke associated with the cigarette, for example, by an airflow flowing through the perforation of the tipping paper, is also known. However, the amount of carbon monoxide in the cigarette smoke is reduced by this at the expense of diluting the taste of the substances defining the cigarette, and hence the taste sensation of the cigarette and customer acceptance are compromised.

The substances in cigarette smoke are determined by a method whereby the cigarettes are smoked under standardized conditions. Such a method is, for example, described in ISO 4387. In this, the cigarette is initially lit at the start of the first puff and then every minute, a puff is taken at the mouth end of the cigarette with a duration of 2 seconds and a volume of 35 $cm^3$ with a sinusoidal puff profile. The puffs are repeated until the length of the cigarette falls below a length which is pre-defined in the standard. The smoke flowing out of the mouth end of the cigarette during the puffs is collected in a Cambridge Filter Pad and this filter is then chemically analyzed with respect to its content of various substances, for example nicotine. The gas phase flowing out of the mouth end of the cigarette during the puffs and through the Cambridge Filter Pad is collected and also chemically analyzed, for example to determine the quantity of carbon monoxide in the cigarette smoke.

During standardized smoking, the cigarette is thus under two different sets of flow conditions. During the puff there is a considerable pressure difference, typically in the range from 200 Pa to 1000 Pa between the inner side of the cigarette paper facing the tobacco and the outer side of the cigarette paper. Due to this pressure difference, air flows through the cigarette paper into the tobacco part of the cigarette and dilutes the smoke being generated during the puff During this phase, which lasts for 2 seconds per puff, the amount of dilution of the cigarette smoke is determined by the air permeability of the paper. The air permeability is measured according to ISO 2965 and defines the air volume per unit time, per unit area and per pressure difference unit which flows through the cigarette paper and hence has the unit $cm^3/(min\ cm^2\ kPa)$. It is often termed the CORESTA Unit (CU, CORESTA Unit) (1CU=1 $cm^3/(min\ cm^2\ kPa)$. With this parameter, the rod ventilation of a cigarette can be adjusted, that is, the air flow which flows through the cigarette paper into the cigarette during a puff at the cigarette. Typically, the air permeability of cigarette papers is in the range 0 CU to 200 CU, whereby the range from 20 CU to 120 CU is generally preferred.

In the period between the puffs, the cigarette smolders without any considerable pressure difference between the inside of the tobacco part of the cigarette and the surroundings, so that the gas transport is determined by the gas concentration difference between the tobacco part and the surroundings. Thereby carbon monoxide can also diffuse through the cigarette paper out of the tobacco part into the ambient air. In this phase, which lasts 58 seconds per puff according to the method described in ISO 4387, the diffusion capacity is the relevant parameter for the reduction of carbon monoxide.

The diffusion capacity is a transfer coefficient and describes the permeability of the cigarette paper for a gas flow that is caused by a concentration difference. More precisely, the diffusion capacity is the gas volume passing through the paper per unit time, per unit area and per concentration difference and hence has the unit $cm^3/(s\ cm^2)$=cm/s. The diffusion capacity of a cigarette paper for $CO_2$ can, for example, be determined by the $CO_2$ Diffusivity Meter from the company Sodim and is closely linked to the diffusion capacity of a cigarette paper for CO.

From the above considerations, it results that the diffusion capacity should have an independent, important significance for the carbon monoxide content in cigarette smoke and that the values for carbon monoxide in cigarette smoke should be able to be reduced by increasing the diffusion capacity. This is of particular importance with respect to the self-extinguishing cigarettes known in the prior art, for which comparably high values of carbon monoxide are observed. In such cigarettes, burn-retarding stripes are applied to the cigarette paper so that they self-extinguish in a standardized test (ISO 12863). This or a similar test is, for example, a part of the legal regulations in the USA, Canada, Australia and the European Union. The increased values of carbon monoxide are due to the fact that carbon monoxide can diffuse only to a very limited extent through the burn-retarding stripes out of the cigarette. It would be of great advantage to have cigarette papers available which compensate for this unwanted side effect.

In practice, however, it turns out to be very difficult to adjust the diffusion capacity independently of the air permeability of the paper in the paper production process. The air permeability by itself, however, is in most cases the subject of the paper specifications required by the cigarette manufacturers, so that—under this requirement—the diffusion capacity results practically from the paper production process and can only be varied within a very small range (compare also B.E.: The influence of the pore size distribution of cigarette paper on its diffusion constant and air permeability, SSPT17, 2005, CORESTA meeting, Stratford-upon-Avon, UK). This is because air permeability as well as diffusion capacity are determined by the porous structure of the cigarette paper, whereby there is a relationship between these parameters, which is given approximately by $D^* \sim Z^{(1/}$ 2), whereby D* is the diffusion capacity and Z the air permeability. This relationship holds above all to a very good approximation if the air permeability of the paper is primarily adjusted by refining the pulp fibers.

From the prior art, various approaches are known for increasing the diffusion capacity of cigarette paper, for example by adding thermally unstable substances (WO 2012013334) or by selecting the mean size of the filler particles (EP 1450632, EP 1809128). Despite such attempts, there is still no instance of increasing the diffusion capacity for a given air permeability.

SUMMARY

The object of the present invention is to provide a cigarette paper which allows for a selective reduction of the carbon monoxide content in cigarette smoke at pre-defined air permeability.

According to the invention, the cigarette paper contains pulp fibers and filler particles, whereby at least a part of the filler particles has a flaked shape. The inventors have observed that the diffusion capacity of the cigarette paper—at constant air permeability—can be increased substantially if at least a part of the filler particles has a flaked shape. Particularly high diffusion capacities can be achieved if the entire filler is formed by flaked particles. Nonetheless, from time to time, a smaller fraction of flaked filler can be used for cost reasons. According to the invention, however, at least 20%, preferably at least 40%, particularly preferably at least 55% and particularly at least 70% of the filler particles, by mass or by particle number, should have a flaked shape. Such different fractions of flaked and non-flaked particles can, for example, be achieved by adding different types of filler in a mixture to the paper.

In a preferred embodiment, the flaked filler particles have a length l, a width b and a thickness d, which each correspond to the maximum dimensions in three spatial directions orthogonal to each other, whereby the length l and the width b are at least twice, preferably at least four times, the thickness d.

The length l and the width b are typically different from each other, but they should differ by a factor of less than 5, preferably less than 3 and particularly preferably less than 2.

In an idealized conception of a nearly cuboid geometry, the length l, the width b and the thickness d could correspond, for example, to the lengths of the sides of the cuboid, that is, it is not at all necessary for the length l to correspond to the maximum dimension of the particle, which in an idealized cuboid would correspond to the body diagonal. As a rule the length l will, however, be greater than or equal to the width b and will itself differ by a factor of 2.5 or less from the maximum spatial extension of the particle.

As an illustration, reference should be made to FIG. 1, which illustrates a flaked filler particle, in which the length l, width b and thickness d are indicated.

As mentioned initially, the diffusion capacity D* is, for conventional papers, to a good approximation proportional to the square root of the air permeability Z in CU, that is, $D^* \sim Z^{(1/2)}$ holds. A typical value for the diffusion capacity for $CO_2$ at an air permeability of Z=50 CU is, for example, 1.65 cm/s. Until now, it has been technically extraordinarily difficult to vary the diffusion capacity D* independently of the air permeability Z such that an increased diffusion capacity D* results at a pre-defined air permeability Z. By using flaked filler according to the invention it is, however, possible, to increase the diffusion capacity D* for $CO_2$ to $D^* \geq 1.80$ cm/s for an otherwise identical paper with an air permeability of Z=50 CU. A similar relative increase of the diffusion capacity D* due to the flaked filler also results for air permeabilities that differ from Z=50 CU. To quantify this effect for general air permeabilities of x CU as well, the diffusion capacity D* for $CO_2$ can be normalized to an expected diffusion capacity at 50 CU by using the relationship $D^* \sim Z^{(1/2)}$, by multiplying it by a factor $\sqrt{50}/\sqrt{x}$, that is, $D_{50}^* = D_x^* \cdot \sqrt{50}/\sqrt{x}$.

Thus, in an advantageous embodiment of the invention $D_x^* \cdot \sqrt{50}/\sqrt{x} \geq 1.80$ cm/s, preferably ≥1.85 cm/s, holds for the diffusion capacity $D_x^*$ for $CO_2$ of a cigarette paper with an air permeability of x CU. This holds particularly for air permeability values x in the range $20 \leq x \leq 120$, preferably $30 \leq x \leq 100$, and at least for papers with filler contents between 20 and 40% by weight.

It has been shown that the geometry, that is, the flaked shape, is essentially more decisive for the effect according to the invention than the mean particle size, that is, the desired effect can be achieved independently of the mean particle size within certain limits. In a preferred embodiment, the mass-specific median $d_{50}$ of the particle size distribution measured according to ISO 13317-3 is between 0.2 μm and 4.0 μm, preferably between 0.5 μm and 3.0 μm.

Since, according to the inventors' investigations, the particle geometry or shape, respectively, is primarily crucial for the increase of the diffusion capacity, the filler material is at first not further limited, as long as the filler is acceptable for cigarette paper for toxicological or legal reasons. Preferably, however, the filler contains flaked calcium carbonate, which in relationship to health-related and legal considerations is completely uncritical. As mentioned initially, it is, however, not required for the filler to be entirely formed by flaked calcium carbonate, instead also calcium carbonates without flaked geometry or entirely different fillers can be added to the mixture.

In a preferred embodiment the calcium carbonate is a calcite, a vaterite or a mixture thereof, which are preferred over aragonite or other modifications of calcium carbonate. Preferably, the mixture consists of 50% by weight to 70% by weight calcite and 30% by weight to 50% by weight vaterite.

The filler according to the invention can be added to the paper in the usual manner, as it is known from the prior art to the skilled person in paper production. In addition, for production of the paper no additional special measures are required after adding the filler according to the invention.

Preferably the entire filler content of the paper is between 10% by weight and 45% by weight, particularly preferably between 20% by weight and 40% by weight. Further, the cigarette paper preferably has a basis weight of 10 g/m$^2$ to 60 g/m$^2$, particularly preferably 20 g/m$^2$ to 35 g/m$^2$.

In a particularly preferred embodiment, the paper is treated in areas with burn-retarding substances, which are able to provide a cigarette manufactured from the paper with self-extinguishing properties. As mentioned initially, such burn-retardant areas obstruct the diffusion of CO out of the cigarette between two sequential puffs. This is the reason why typically increased CO values are observed for such self-extinguishing cigarettes. This is a substantial problem because the increased fire protection should not increase the harmfulness of cigarette smoke. With the cigarette paper according to the invention, the typical increase in the CO content in the cigarette smoke due to the burn-retardant areas can be at least partially compensated for by the increased diffusion capacity of the paper in the untreated areas. Thus, the invention provides a specific technical effect in relationship to such treated papers.

BRIEF DESCRIPTION OF THE DRAWINGS

FIG. 1 is a schematic drawing of a flaked filler particle, where the length l, the width b and the thickness d are shown.

DETAILED DESCRIPTION

EXAMPLE 1

The starting point for Example 1 is a cigarette paper not according to the invention comprising wood pulp fibers and 25.5% by weight of a conventional, non-flaked, precipitated calcium carbonate, which serves as an example for comparison. Further substances, however, for example, burn additives, can be included. The cigarette paper had a basis weight of 28.2 g/m$^2$ and an air permeability of 46.9 CU. The $CO_2$ diffusion capacity was measured with a $CO_2$ Diffusivity Meter from the company Sodim after conditioning the paper according to ISO 187 and was found to be $D_{46.9}^*$=1.59 cm/s.

A further, identical cigarette paper was produced, for which a calcium carbonate with flaked particles was used instead of the conventional calcium carbonate. An X-ray structural analysis showed that it was a mixture of about 60% by weight calcite and about 40% by weight vaterite. The mean particle diameter was about 1.1 μm. A method to produce such flaked calcium carbonate is described in EP 1 151 966 B1.

It can be seen that by exchanging the calcium carbonate, an increase in the diffusion capacity from 1.59 cm/s to 1.81 cm/s can be achieved with practically identical paper properties, that is by 13.8%. It has to be considered here that the air permeability of the paper with the flaked chalk according to the invention is slightly lower, at 41.7 CU, than that of the paper of the comparative example, at 46.9 CU. This small difference in air permeability can be easily compensated for, for example, by changing the refining intensity of the pulp and it is to be expected that with identical air permeability, the increase in diffusion capacity would be even greater. If the diffusion capacity is normalized to an air permeability of 50 CU in the manner described above, a normalized diffusion capacity of $D_{50}^*$=1.59 cm/s·$\sqrt{50}/\sqrt{46.9}$=1.64 cm/s results for the comparative example, while for the cigarette paper of example 1 with the flaked chalk according to the invention, a normalized diffusion capacity $D_{50}^*$ of 1.81 cm/s·$\sqrt{50}/\sqrt{41.7}$=1.98 cm/s is obtained.

EXAMPLE 2

A cigarette paper not according to the invention comprising 30.2% by weight of a conventional, non-flaked, precipitated calcium carbonate was produced as comparative example. The paper had a basis weight of 28.8 g/m$^2$, an air permeability of 60.6 CU and a diffusion capacity of 1.84 cm/s, again measured with the $CO_2$ Diffusivity Meter from the company Sodim after conditioning the paper according to ISO 187. This corresponds to a value normalized to 50 CU of $D_{50}^*$=1.84 cm/s·$\sqrt{50}/\sqrt{60.6}$=1.67 cm/s, which is thus similar to that of the comparative example of Example 1.

This cigarette paper was modified by using a mixture of calcite and vaterite with a flaked structure instead of the conventional calcium carbonate. The modified cigarette paper had a filler content of 31.0% by weight, a basis weight of 29.1 g/m$^2$ and an air permeability of 59.5 CU. The diffusion capacity was 2.17 cm/s. An increase in the diffusion capacity from 1.84 cm/s to 2.17 cm/s, i.e.17.9%, could be achieved thereby for otherwise almost identical paper properties. Such a high diffusion capacity as obtained with the paper according to the invention according to example 2 would be expected for conventional cigarette papers at an air permeability of at least about 85 CU. The diffusion capacity $D_{50}^*$ normalized to an air permeability of 50 CU is thereby 2.17 cm/s·$\sqrt{50}/\sqrt{59.5}$=1.99 cm/s and is therefore similar to Example 1.

Consequently, the cigarette papers according to the invention allow a substantially improved diffusion of carbon monoxide out of the tobacco rod of a cigarette manufactured from this paper, without having to change the air permeability of the cigarette paper.

Although various exemplary embodiments of the invention have been disclosed, it should be apparent to those skilled in the art that various changes and modifications can be made which will achieve some of the advantages of the invention without departing from the true scope of the invention.

What is claimed is:

1. Cigarette paper, which contains pulp fibers and filler particles, whereby at least 20% of the filler particles, by mass or by particle number, have a flaked shape, wherein the flaked filler particles have a length l, a width b and a thickness d, which correspond to the respective maximum extension in three mutually orthogonal spatial directions, whereby the length l as well as the width b are at least twice as large as the thickness d, wherein the mass-specific median value $d_{50}$ of the particle size distribution measured according to ISO 13317-3 is between 0.2 μm and 4.0 μm, and wherein the flaked particles are formed by calcium carbonate; and wherein the cigarette paper has an air permeability of x CORESTA Units and a diffusion capacity $D_x^*$ for $CO_2$, and whereby $D_x^*\cdot\sqrt{50}/\sqrt{x}\geq 1.80$ cm/s holds.

2. Cigarette paper according to claim 1, wherein $D_x^*\cdot\sqrt{50}/\sqrt{x}\geq 1.85$ cm/s holds.

3. Cigarette paper according to claim 1, wherein $D_x^*\cdot\sqrt{50}/\sqrt{x}\geq 1.90$ cm/s holds.

4. Cigarette paper according to claim 1, whereby $20\leq x\leq 120$ holds.

5. Cigarette paper according to claim 1, wherein preferably $30\leq x\leq 100$ holds.

6. Cigarette paper according to claim 1, wherein the mass-specific median value $d_{50}$ of the particle size distribution measured according to ISO 13317-3 is between 0.5 μm and 3.0 μm.

7. Cigarette paper according to claim 1, whereby the calcium carbonate comprises a calcite, a vaterite or a mixture thereof.

8. Cigarette paper according to claim 7, whereby the mixture consists of 50% by weight to 70% by weight calcite and 30% by weight to 50% by weight vaterite.

9. Cigarette paper according to claim 1, wherein the entire filler content of the paper is between 10% by weight and 45% by weight.

10. Cigarette paper according to claim 1, wherein the entire filler content of the paper is between 20% by weight and 35% by weight.

11. Cigarette paper according to claim 1, wherein the basis weight is between 10 g/m$^2$ and 60 g/m$^{22}$.

12. Cigarette paper according to claim 1, wherein the basis weight is between 20 g/m$^2$ and 35 g/m$^2$.

13. Cigarette paper according to claim 1, wherein the paper is treated in areas with burn-retardant substances, which are suitable for providing a cigarette manufactured from the paper with self-extinguishing properties.

14. Cigarette paper of claim 1, wherein at least 40% of the filler particles, by mass or by particle number, have a flaked shape.

15. Cigarette paper of claim 1, wherein at least 55% of the filler particles, by mass or by particle number, have a flaked shape.

16. Cigarette paper of claim 1, wherein at least 70% of the filler particles, by mass or by particle number, have a flaked shape.

17. A cigarette, comprising a tobacco rod and a cigarette paper wrapping the tobacco rod, whereby the cigarette paper is a cigarette paper, which contains pulp fibers and filler particles , whereby at least 20% of the filler particles, by mass or by particle number, have a flaked shape, wherein the flaked filler particles have a length l, a width b and a thickness d, which correspond to the respective maximum extension in three mutually orthogonal spatial directions, whereby the length l as well as the width b are at least twice as large as the thickness d, wherein the mass-specific median value $d_{50}$ of the particle size distribution measured according to ISO 13317-3 is between 0.2 μm and 4.0 μm, and wherein the flaked particles are formed by calcium carbonate; and wherein the cigarette paper has an air permeability of x CORESTA Units and a diffusion capacity $D_x^*$ for $CO_2$, and whereby $D_x^* \cdot \sqrt{50}/\sqrt{x} \geq 1.80$ cm/s holds.

* * * * *